US005819674A

United States Patent [19]

Papajewski et al.

[11] Patent Number: 5,819,674

[45] Date of Patent: Oct. 13, 1998

[54] BIGHT MECHANISM FOR A BUTTONHOLE SEWING MACHINE

[75] Inventors: Rudy Papajewski, deceased, late of Stutensee, by Edith Alice Papajewski, heiress; Gerd Papajewski, Stutensee, both of Germany

[73] Assignee: AMF Reece, Inc., Mechanicsville, Va.

[21] Appl. No.: 716,536

[22] Filed: Sep. 19, 1996

[51] Int. Cl.[6] ..... D05B 3/06

[52] U.S. Cl. ..... 112/65; 112/446; 112/475.25

[58] Field of Search ..... 112/65, 66, 67, 112/69, 73, 446, 448, 449, 475.25

[56] References Cited

U.S. PATENT DOCUMENTS

| | | | |
|---|---|---|---|
| 1,437,847 | 12/1922 | Kiewicz . | |
| 1,914,943 | 6/1933 | Dunnell, Jr. . | |
| 2,308,707 | 1/1943 | Myers . | |
| 2,321,447 | 6/1943 | Zonis . | |
| 2,713,838 | 7/1955 | Johnson et al. . | |
| 3,130,697 | 4/1964 | Meier | 112/448 |
| 3,160,126 | 12/1964 | Moro . | |
| 3,401,659 | 9/1968 | Kasuga . | |
| 4,577,575 | 3/1986 | Stevens et al. . | |
| 4,768,452 | 9/1988 | Baruffa et al. . | |
| 4,981,093 | 1/1991 | Schopf . | |
| 5,095,834 | 3/1992 | Braun . | |

FOREIGN PATENT DOCUMENTS

| | | | |
|---|---|---|---|
| 391440 | 9/1965 | Switzerland | 112/446 |
| 1163689 | 9/1969 | United Kingdom | 112/448 |

*Primary Examiner*—Ismael Izaguirre
*Attorney, Agent, or Firm*—James Creighton Wray; Meera P. Narasimhan

[57] ABSTRACT

Bight stitches at sides and bar tack stitches at ends of a buttonhole site are formed by periodically oscillating a needle bar holder over lesser and greater angles while a needle is in an up position. The needle bar holder is fixed to a horizontal transverse shaft. One end of a long, generally vertical arm is clamped to the shaft, and a generally horizontal link is pivoted to a lower end of the arm and to an adjustment slide in an upper arm of the inverted Y-shaped follower plate. The Y-shaped follower plate is pivoted on a central horizontal pivot. A double cam engages cam follower rollers oppositely extending from lower ends of the Y-shaped follower plate. Periodically, while the needle is up, the cams move the follower plate back and forth.

12 Claims, 2 Drawing Sheets

FIG. 2
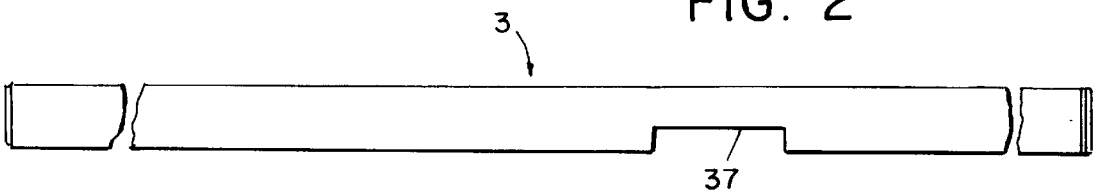
FIG. 6
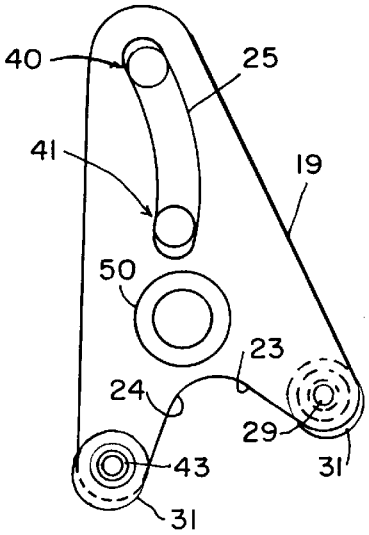
FIG. 7
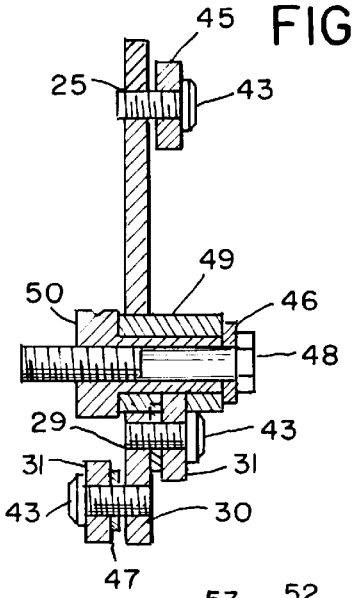
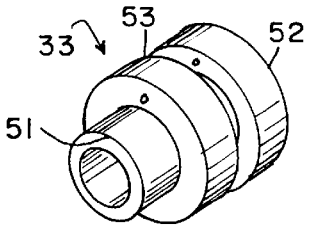
FIG. 8
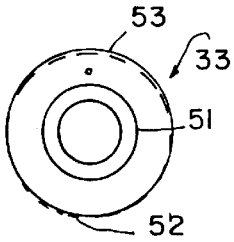
FIG. 9
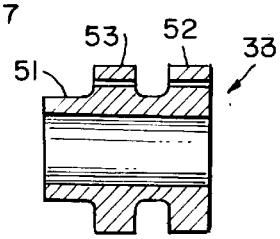
FIG. 10
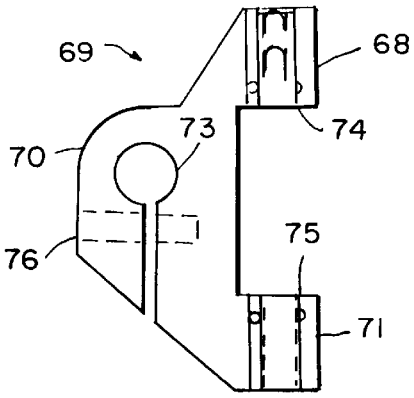
FIG. 11

BIGHT MECHANISM FOR A BUTTONHOLE SEWING MACHINE

BACKGROUND OF THE INVENTION

The present invention relates to an improved bight mechanism used to facilitate stitching in buttonhole sewing machines. A needle bar, which carries the main thread-bearing needle, swings back and forth to create a bight pattern of stitches in a garment along sides and large tack stitches at the ends of a location where a buttonhole is to be formed. The stitching strengthens and secures the area around where the buttonhole is to be formed.

Needs exist for simple, efficient, and reliable mechanical drives to repetitively form reinforcement stitches around areas of garments in which buttonholes are formed.

SUMMARY OF THE INVENTION

A strength of the present invention is simplicity of operation. A double cam drive moves the needle housing in the desired bight and tack stitching patterns. The single drive provides the reciprocating motion without the use of a springs and allows for precise control of the stitching. The uncomplicated mechanism has few parts and few potential sources of failure.

The prior art does not demonstrate the simplicity and reliability of the present bight mechanism. While many previous inventions allow for proper stitching to occur with the main needle, the use of a simple adjustment mechanism, a double cam drive and few parts allow for greater mechanical stability of the mechanism.

An objective of the present invention is to remedy the disadvantages of the prior art by providing a reliable apparatus that allows users to form buttonholes in garments.

The single drive with a double cam provides reciprocation of the needle housing without the use of a spring and provides precise control of the stitching. A simple adjustment of the coupling between the drive and the lever provides the changes in movement of the needle bar assembly. The limited number of parts creates fewer chances for error or failure. Fewer parts need to be replaced in the event of failure of some part of the mechanism.

In a preferred embodiment a needle bar holder is swung back and forth across the machine direction by a shaft. The shaft is connected transversely to a lever. Motion of the lever oscillates the shaft back and forth around its center axis. A coupling is connected to the lever. The coupling is adjustable so that the amount of swing in the lever can be altered. The coupling is connected to a driver for reciprocating the coupling, and thus the lever, back and forth.

The preferred coupling is a Y-shaped follower plate having an upper end connected to the lever. The connection is adjustable and allows for changes the amount of swing in the lever. Lower ends of the follower plate are connected to the driver. The follower plate pivots about a center opening. A link is pivotally connected to the lever and couples the motion of the follower plate to the lever. The follower plate has an elongated opening in the upper end where the link is connected. The elongated opening allows the connection to slide from an end of the opening to an opposite end such that it functions as an adjustment slide. An adjuster determines the position of the slide.

In a preferred embodiment, the lever is clamped onto the shaft. The driver comprises a second shaft for providing rotary motion and a bite cam with two cams extending around a cylindrical body, one cam near a rear end of the cylindrical body and another cam at a middle portion of the cylindrical body. The lower ends of the follower plate have cam follower rollers attached on opposite sides of the follower plate. Each cam of the bite cam makes contact with one of the cam follower rollers as the bite cam rotates. That converts the rotary motion of the second shaft into a reciprocating motion to reciprocate the follower plate.

These and further and other objects and features of the invention are apparent in the disclosure, which includes the above and ongoing written specification, with the claims and drawings.

BRIEF DESCRIPTION OF THE DRAWINGS

FIG. 2 is an elevation of a shaft for swinging a needle bar holder.

FIG. 6 is an elevational view of a follower plate assembly.

FIG. 7 is a cross sectional view of the follower plate assembly.

FIG. 8 is an elevation of a bite cam with double cams.

FIGS. 8, 9 and 10 are perspective, end and cross sectional views respectively of a bite cam with double cams.

FIG. 11 shows a needle bar holder which is pivoted by the bight mechanism.

DETAILED DESCRIPTION OF THE DRAWINGS

Figure 1:
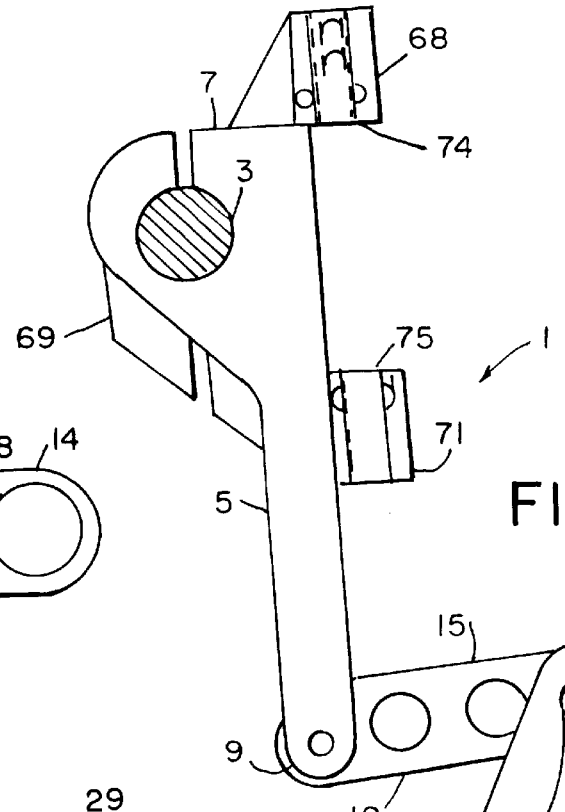
FIG. 1 is an assembly elevation of a bight mechanism for a buttonhole sewing machine.

A bight mechanism 1 is shown in FIG. 1. A shaft 3, as shown in FIGS. 1 and 2, has a notch 37 for belt clearance. The needle bar holder 69 has an oblong end 70 with a large opening 73 through the end and an orifice 76 transverse to the large opening for clamping the shaft in the large opening. The needle bar holder 69 has two block-like ends 68, 71 with passages 74, 75 passing through the block-like ends for holding a needle bar.

Figure 3:
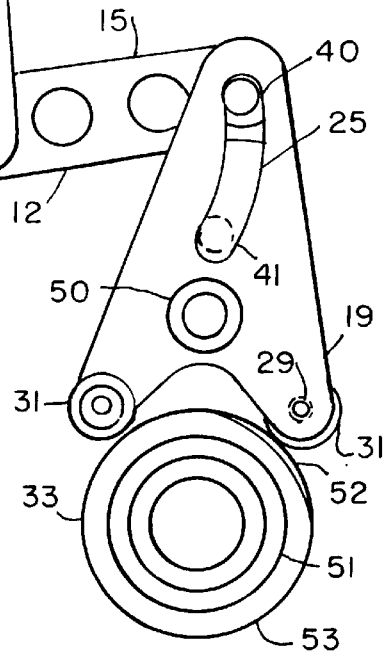
FIG. 3 is an elevation of a lever.
Figure 3:
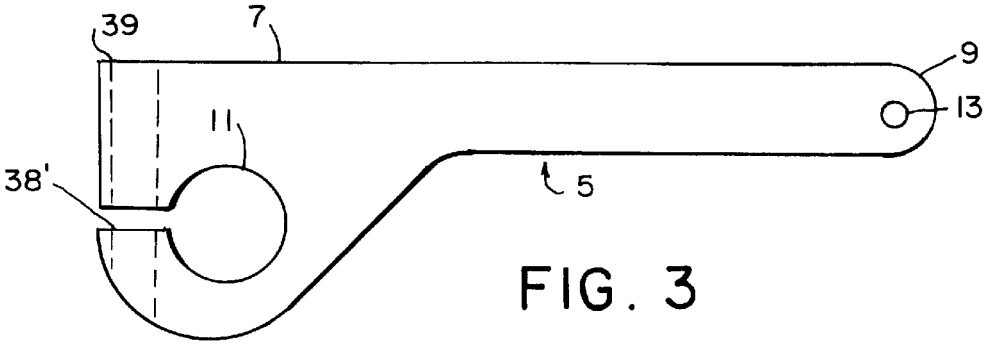

The shaft 3 is also connected to a lever 5 as shown in FIGS. 1 and 3. The lever 5 has a first end 7 connected to the shaft through a large opening 11 and a second end 9. The second end 9 has a small hole 13. The first end 7 has a slot 38 and an opening 39 to receive a set screw so that the shaft 3 can be clamped in the large opening 11.

Figure 4:
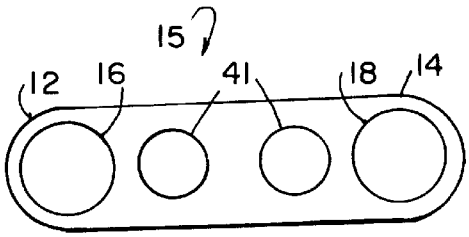
FIG. 4 is an elevation of a link for connecting between the lever and an actuator.
Figure 5:
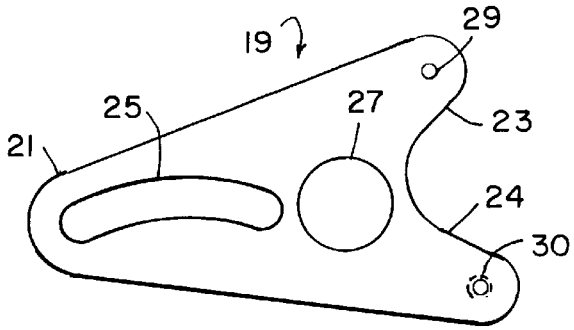
FIG. 5 is an elevation of a Y-shaped follower plate.

The second end of the lever 5 is connected to a link 15, shown in FIGS. 1 and 4, through the small hole 13 in the lever. The link has a pivotal end 12 and an adjustable end 14. The link has a first aperture 16 on the pivotal end 12 and a second aperture 18 at the adjustable end 14. Two other mass-reducing apertures 41 are closer to the center of the link.

A pivotal connection between the link 15 and a Y-shaped follower plate 19, as shown in FIGS. 1, 5, 6 and 7, is made through the second aperture 18 of the link 15 and through an elongated arcuate opening 25 in an upper end 21 of the follower plate 19. The follower plate has a center opening 27 for receiving a bearing on which the follower plate pivots. Lower ends 23, 24 of the follower plate 19 have small apertures 29, 30. Cam follower rollers 31 are mounted in the small apertures 29, 30. One follower roller is positioned on each side of the follower plate 19.

In FIGS. 6 and 7, the two small apertures 29, 30 can be seen, each receiving a screw 43 which passes through a washer 47 and one of the two cam follower rollers 31. The elongated opening 25 receives a screw 43 which passes through a bearing 45 and connects to an adjuster. In operation, the screw 43 through the elongated opening 25 also passes through the second aperture 18 of the link 15 as shown in FIG. 1. The center opening 27 receives a larger screw 48 which passes through a washer 46, a bushing 49, and a stud 50.

FIG. 6 shows two positions 40, 41 of an adjustment slide formed from the connection through the elongated hole 25. A first position 40 creates a larger translation in the link 15 per cycle than a second position 41. A larger translation in the link 15 creates a larger rocking of the lever 5, which causes a larger angle of swing in the shaft 3, and thereby a larger movement of the needle bar holder 69.

The cam follower rollers 31 maintain contact with the double bite cam 33, shown in FIGS. 1, 8, 9, and 10, which rotates about a central axis. The bite cam 33 has a cylindrical body 51 and two cams 52 and 53 surrounding the cylindrical body, one cam 52 at a rear end and another cam 53 at a middle portion. The follower plate 19 is situated between the cams 52, 53 of the bight cam 33. Each cam of the bite cam 33 maintains contact with one of the cam follower rollers 31 as the bite cam rotates, to positively control the movement of the plate.

In operation, the bite cam 33 rotates about a central axis and each cam makes contact with and moves against a cam follower roller 31. This motion causes the follower plate 19 to pivot and oscillate about a bearing in a center hole 27. An adjuster sets the position of the connection between the link 15 and the follower plate 17 to an intermediate position or to either end of the elongated opening 25, at the first or second positions 40, 41. The setting of the adjuster determines the amount of translation that the link 15 undergoes.

The motion of the link 15 is transferred to the lever 5 at pivotal connection 13. The amount of translation in the link 15 sets the amount of swing in the lever 5. The lever 5 is transversely clamped to the shaft 3 and turns the shaft 11 as the lever 5 swings back and forth. The amount of swing in the lever 5 determines the angle over which the shaft 3 oscillates. The shaft 3 is connected to a needle bar holder. Thus the oscillating of the shaft 3 swings the needle bar holder and a resulting pattern of stitching is formed by the sewing motion of needle.

In operation, the bite cam 33 rotates. While the needle is up, positive follower roller contact oscillates the follower plate 19. The adjuster positions the slide in the elongated opening 25 controlling the size and side of the bight stitches at sides of the buttonhole site. The size of the bar tack stitches at the ends of the buttonhole are controlled by clamp-plate movement. The slide moves the link 15, and the link oscillates the lever 5. The lever turns the shaft 3, turning the needle bar holder 69 while the needle is up, to control the bight stitches.

While the invention has been described with reference to specific embodiments, modifications and variations of the invention may be construed without departing from the scope of the invention, which is defined in the following claims.

We claim:

1. A bight apparatus for creating bight and bar tack stitches in a buttonhole sewing machine comprising a needle bar guide, a shaft with a guide end and a lever end, the shaft fixedly connected to the needle bar guide, at the guide end, so as to swing the needle bar assembly back and forth by motion of the shaft at intervals when a needle is up out of a workpiece being sewn, a lever having a first end and a second end with the first end connected transversely to the shaft such that motion of the lever turns the needle bar guide and the shaft around a central axis of the shaft, a coupling pivotally connected to the lever at the second end, the coupling being adjustable for altering the amount of swing in the lever, and a means for moving the coupling back and forth.

2. A bight apparatus for creating bight and bar tack stitches in a buttonhole sewing machine comprising a needle bar guide, a shaft with a guide end and a lever end, the shaft connected to the needle bar guide, at the guide end, so as to swing the needle bar assembly back and forth by motion of the shaft at intervals when a needle is up out of a workpiece being sewn, a lever having a first end and a second end with the first end connected transversely to the shaft such that motion of the lever turns the shaft around a central axis of the shaft, a coupling pivotally connected to the lever at the second end, the coupling being adjustable for altering the amount of swing in the lever, and a means for moving the coupling back and forth, wherein the coupling further comprises an inverted Y-shaped follower plate having an upper end and two lower ends, wherein the upper end is connected to the lever and is adjustable for changing the amount of the swing in the lever, and the lower ends are connected to an oscillator for oscillating the plate, and having a center opening about which the follower plate pivots to transfer the motion of the reciprocating means.

3. The apparatus in claim 2, wherein the coupling further comprises a link, pivotally connected to the lever at the second end and wherein the follower plate has an elongated opening in the upper end and the link is pivotally connected through the elongated opening such that the connection slides from an end of the opening to an opposite end such that it functions as an adjustment slide.

4. The apparatus in claim 3, wherein the first end of the lever is larger and clamps onto the shaft through a large opening passing through the first end of the lever, using a set screw to keep the shaft positioned, and wherein the second end of the lever pivotally connects to the link of the coupling through a smaller hole in the second end with a lever link pin.

5. The apparatus in claim 3, wherein the oscillator moving the follower plate further comprises a rotor for providing rotary motion, a bite cam having a cylindrical body with first and second ends, a first cam extending around the cylindrical body near the first end of the cylindrical body and a second cam extending around a middle portion of the cylindrical body, wherein the lower ends of the follower plate each have a small aperture and a cam follower roller is connected to each of the lower ends through each small aperture, with the bite cam connected to the rotor and to the cam follower rollers, with each cam respectively making contact with the cam follower rollers as the bite cam rotates, for converting the rotary motion of the rotor into a reciprocating motion for reciprocating the follower plate.

6. The apparatus of claim 3, wherein a position of the connection in the elongated opening is adjustable to rock the needle bar assembly in the correct directions for rocking over small distances to make the bight stitches at edges of a buttonhole.

7. A method for swinging a needle bar assembly for creating a bight pattern for a buttonhole sewing machine comprising an oscillator pushing alternatively against either lower end of an inverted Y-shaped follower plate, pivoting the follower plate about a center hole and moving a link pivotally connected to the follower plate via an elongated opening in the follower plate, moving the link back and forth with the follower plate, moving a second end of a lever back and forth with the link, wherein the lever has a first end and the lever is pivotally connected to the link at the second end of the lever, and the first end of the lever is connected to a shaft, wherein the lever moving back and forth causes pivoting of the shaft about a center axis of the shaft, wherein swinging a needle bar assembly, connected to the shaft, back and forth by the pivoting of the shaft for making a bight pattern by the stitching of a workpiece in the making of a buttonhole, and adjusting a position of the link at an elongated opening in the follower plate.

8. Apparatus for creating bight stitches along sides and bar tack stitches at ends of a buttonhole site in a buttonhole sewing machine comprising a needle bar holder, a shaft with a holder end and a lever end, the shaft fixedly connected to the needle bar holder at the holder end so as to move the holder back and forth by oscillating motion of the shaft, a lever having a first end and a second end with the first end connected transversely to the shaft such that a swinging motion of the lever turns and oscillates the needle bar guide and the shaft around a central axis of the shaft, a coupling pivotally connected to the lever at the second end, the coupling being adjustable for altering an amount of swing of the lever, and a means for reciprocating the coupling back and forth.

9. Apparatus for creating bight stitches along sides and bar tack stitches at ends of a buttonhole site in a buttonhole sewing machine comprising a needle bar holder, a shaft with a holder end and a lever end, the shaft connected to the needle bar holder at the holder end so as to move the holder back and forth by oscillating motion of the shaft, a lever having a first end and a second end with the first end connected transversely to the shaft such that a swinging motion of the lever turns and oscillates the shaft around a central axis of the shaft, a coupling pivotally connected to the lever at the second end, the coupling being adjustable for altering an amount of swing of the lever, and a means for reciprocating the coupling back and forth, wherein the coupling comprises an inverted Y-shaped follower plate having a first end and two second ends, where the first end is adjustably connected to the lever for changing swinging in the lever, and wherein the second ends are connected to a mover, the follower plate having a central bearing about which the follower plate pivots to transfer the motion from the mover to the lever, shaft and needle bar holder.

10. The apparatus in claim 9, wherein the coupling further comprises a link having a first and second ends, the first end of the link pivotally connected to the second end of the lever, a slide connected to the second end of the link, wherein the follower plate has an elongated opening in the first end and the slide is pivotally connected through the elongated opening for allowing the slide to slide from one end of the opening to an opposite end such that the slide functions as an adjustment slide.

11. The apparatus in claim 10, wherein the first end of the lever is larger than the second end and the first end clamps onto the shaft through a large slotted opening passing through the first end of the lever using a set screw to close a slot and lock the shaft in the large opening, and the second end of the lever is pivotally connected to the link through a smaller hole in the second end by a lever link pin.

12. The apparatus in claim 11, wherein the mover further comprises a double cam having a cylindrical body, a first cam extending around the cylindrical body, and a second cam wherein the second ends of the follower plate have first and second cam follower rollers respectively connected thereto, with each cam maintaining contact with one of the cam follower rollers as the double cam rotates, for converting the rotary motion of the double cam into a periodic oscillating motion of the follower plate.

* * * * *